United States Patent [19]

Kamifuji et al.

[11] Patent Number: 4,873,960

[45] Date of Patent: Oct. 17, 1989

[54] ELECTRONICALLY-CONTROLLED FUEL INJECTION SYSTEM FOR INTERNAL COMBUSTION ENGINES

[75] Inventors: Hiroshi Kamifuji; Yoshiyuki Tanabe; Kiyomi Morita, all of Katsuta, Japan

[73] Assignee: Hitachi, Ltd., Tokyo, Japan

[21] Appl. No.: 214,484

[22] Filed: Jul. 1, 1988

[30] Foreign Application Priority Data

Jul. 3, 1987 [JP] Japan ..... 62-165197

[51] Int. Cl.[4] ..... F02D 41/30; F02D 41/04; F02M 51/00

[52] U.S. Cl. ..... 123/480; 123/486; 73/118.1

[58] Field of Search ..... 123/337, 339, 478, 480, 123/486, 492, 493, 494; 73/118.1, 118.2; 364/431.05

[56] References Cited

U.S. PATENT DOCUMENTS

| | | | |
|---|---|---|---|
| 4,417,468 | 11/1983 | Yasuda et al. | 73/118.1 |
| 4,515,009 | 5/1985 | Hasegawa et al. | 73/118.1 |
| 4,526,042 | 7/1985 | Yamazoe et al. | 73/118.2 X |
| 4,587,938 | 5/1986 | Kobayashi et al. | 123/480 X |
| 4,644,920 | 2/1987 | Abe et al. | 123/486 X |
| 4,688,533 | 8/1987 | Otobe | 123/337 |
| 4,715,220 | 12/1987 | Eitoku et al. | 73/118.1 |
| 4,727,845 | 3/1988 | Misumi et al. | 123/480 X |

FOREIGN PATENT DOCUMENTS 0056632 4/1982 Japan .

*Primary Examiner*—Willis R. Wolfe

*Attorney, Agent, or Firm*—Antonelli, Terry & Wands

[57] ABSTRACT

An electronically-controlled fuel injection system for an internal combustion engine including means including a computer for electronically controlling a fuel injection quantity of an engine, means for detecting a rotational speed of the engine and a throttle sensor having lower and higher opening regions for detecting an opening of a throttle valve is further provided with means for storing the ratio between the slopes of output voltage characteristic curves derived from the regions with respect to a throttle opening in a range where the ranges of throttle openings to be detected in the regions overlap, and means for correcting the output voltage generated from one of the regions by use of the ratio in a throttle opening range exceeding said overlapping range.

5 Claims, 5 Drawing Sheets

ELECTRONICALLY-CONTROLLED FUEL INJECTION SYSTEM FOR INTERNAL COMBUSTION ENGINES

BACKGROUND OF THE INVENTION

The present invention relates to a fuel injection system equipped with electronic fuel control means and more particularly to a fuel injection system having lower and higher opening region throttle sensing systems such that in accordance with the electric signals generated from the two sensing systems and changeover between the sensing systems is automatically and smoothly effected to control the quantity of fuel injected from fuel injection valves.

Techniques of employing electronic circuitry to control the quantity of fuel injected by a fuel injection system are well known in the art as disclosed for example in JP-A-57-56632. This patent application discloses a fuel control method featuring that the quantity of fuel supplied to the engine is controlled in accordance with the amount of intake air flow detected from the rate of air flow detected by a hot-wire flow meter when the throttle opening detected by a throttle sensor is in the range from the idling opening to a given value, and the fuel quantity is controlled in accordance with a predetermined throttle opening corresponding to the output value of an engine speed sensor for detecting the speed of the engine and the amount of intake air flow corresponding to the engine speed.

An electronically-controlled fuel injection system to which the present invention is applicable will now be described with reference to FIG. 1.

The flow rate of air drawn from an air cleaner 1 is varied by a throttle valve 4 disposed in a throttle control section 2.

The throttle valve 4 is linked to an accelerator pedal 3 and operated by the driver.

The air (intake air) passed through the throttle valve 4 is supplied to a combustion chamber 9 of an engine 8 through a surge tank 5, an intake manifold 6 and an intake valve 7. The mixture burned in the combustion chamber 9 is discharged to the atmosphere through an exhaust valve 10 and an exhaust manifold 11. While a fuel injection valve 14 is fitted into the intake manifold 6 for each of the combustion chamber 9, it is possible to provide only a single fuel injection valve upstream of the throttle valve 4.

As shown in detail in FIG. 2, an electronic control unit 15 includes a microprocessor which functions as a computer, a read-only memory (ROM), a random-access memory (RAM), input and output devices (I/O ports), etc., and the control unit 15 receives input signals from a throttle sensor 16 for detecting the rotational angle of the throttle valve 4, a water temperature sensor 18 fitted into a water jacket 17, an intake air temperature sensor 20 for detecting the intake air temperature, a rotational angle sensor 32 for detecting the rotational angle of a distributor 12 coupled to the crankshaft to detect the rotational speed of the crankshaft coupled to a piston 21 through a connecting rod 22, an ignition switch 24, a starter switch 25, etc. The rotational angle sensor 23 includes a position detector for generating a pulse for every two revolutions of the crankshaft and an angle detector for generating a pulse for every given crank angle, e.g., 1°. The fuel is forced to each fuel injection valve 14 by a fuel pump 31 from a fuel tank 30 through a fuel passage 29. In accordance with the various input signals, the electronic control unit 15 computes a fuel injection quantity and a fuel injection timing to apply a fuel injection pulse to the fuel injection valve 14 and also computes an ignition timing to supply a current to an ignition coil 32. The secondary current of the ignition coil 32 is supplied to a distributor 33 which in turn distributes it to the respective spark plugs.

FIG. 2 is a block diagram showing the construction of the electronic control unit 15 and the outputs of the water temperature sensor 18, the intake air temperature sensor 20 and the throttle sensor 16 are sent to an A/D converter 34 which in turn convert them to digital signals. An engine speed detecting circuit 35 counts the number of pulses applied within a given time from the angle detector of the rotational angle sensor 23 to generate a value proportional to the engine speed. Numeral 36 designates a clock generator for controlling a digital operation. The outputs of the ignition switch 24 and the starter switch 25 are temporarily stored in a latch circuit 37. A microprocessor 40 is connected to an ROM 42, an RAM 43 as well as the A/D converter 34, the engine speed detecting circuit 35 and the latch circuit 37 through a bus line 41 to compute a fuel injection quantity in accordance with a predetermined program. The value corresponding to this fuel injection quantity is stored in a fuel injection control circuit 44 so that when the stored value coincides with the number of the clock pulses applied, an output pulse is generated and this output pulse is supplied to the fuel injection valve 14 through a driver circuit 45 for driving the fuel injection valves. The flow rate of air passed through the intake system is obtained by calculation from the throttle opening obtained from the output of the throttle sensor 16 and the engine speed obtained from the rotational angle sensor 23. While the fuel injection quantity is computed in accordance with the previously mentioned air flow rate, when the output of the throttle sensor 16 is taken into the computer, it is converted from the analog value to a digital value and therefore the fuel injection quantity is handled as a discrete data in terms of minimum bits. In order to make uniform the resolution of inputted data for all the air flow rate, the throttle sensor 16 includes a lower-opening throttle sensing system and a higher-opening throttle sensing system as shown in FIG. 3. In the throttle sensor of FIG. 3, the lower opening system includes a resistor 52 and conductors 56 and 57 which are arranged on the base as shown in the Figure and the resistor 52 and the conductor 56 are electrically connected by a brush 54 disposed on a lever 62 which is mounted on a throttle valve shaft 63. At this time, if a constant voltage is applied across the terminals 57 and 59 of the resistor 52, as shown at a in FIG. 4, a lower-opening throttle sensor output voltage is applied across the terminals 58 and 59 in accordance with the rotational angle of the throttle valve shaft 63. On the other hand, the higher opening system includes similarly a resistor 51, a brush 53, a conductor 55, the conductor 57, etc., and a higher-opening throttle sensor output is generated across terminals 60 and 61 as shown in b in FIG. 4. As will been seen from FIG. 4, the slope of the straight line for the lower-opening sensing system is greater than that of the higher-opening sensing system, that is, the former is higher in throttle opening resolution than the latter.

Then, due to a positional shift caused between the throttle sensing system by a manufacturing error, the variations in resistance value among the resistors due to manufacturing errors or the like, in FIG. 4 any deviation in the throttle opening axis direction, variations of the ratio between the slopes of the straight line a (the lower opening line) and the straight line b (the higher opening line) or the like cannot be avoided from the hardware point of view. Thus, there is a disadvantage that if the lower-opening a track and the higher-opening b track are separately inputted and processed in the computer, upon the changeover between the lower-opening track and the higher-opening track the throttle sensor output is caused to vary stepwise or the slopes of the tracks (FIG. 4) are varied, thereby causing a rapid increase or deviation of the air-fuel ratio during the changeover between the lower-opening track and the higher-opening track with the resulting deterioration of the driving performance and the exhaust emission.

SUMMARY OF THE INVENTION

It is an object of the present invention to provide an electronically-controlled fuel injection system including two throttle sensing systems (lower-opening and higher-opening systems), which is capable of smoothly effecting the changeover between the two sensing systems irrespective of any error during the manufacture of the throttle valve.

To accomplish the above object, in accordance with the invention there is thus provided a fuel injection system featuring that (a) means is provided to store the ratio between "the slopes of the throttle opening versus output voltage characteristic curves" of the two sensing systems within their overlapping detecting ranges and (b) means is provided to correct the sensor output by use of the ratio upon the changeover between the sensing systems.

In accordance with this construction, the output of the sensing system of a higher throttle opening resolution (the lower-opening sensing system in this embodiment) within a throttle opening range (the R—S region of FIG. 4) where the detecting ranges of the two sensing systems overlap, whereas the sensor output is corrected in accordance with the ratio between the characteristics of the sensing systems within a throttle opening range exceeding the upper limit (S) of the overlapping range, thereby smoothly effecting the switching between the outputs of the sensing systems.

DESCRIPTION OF THE PREFERRED EMBODIMENTS

Figure 4:
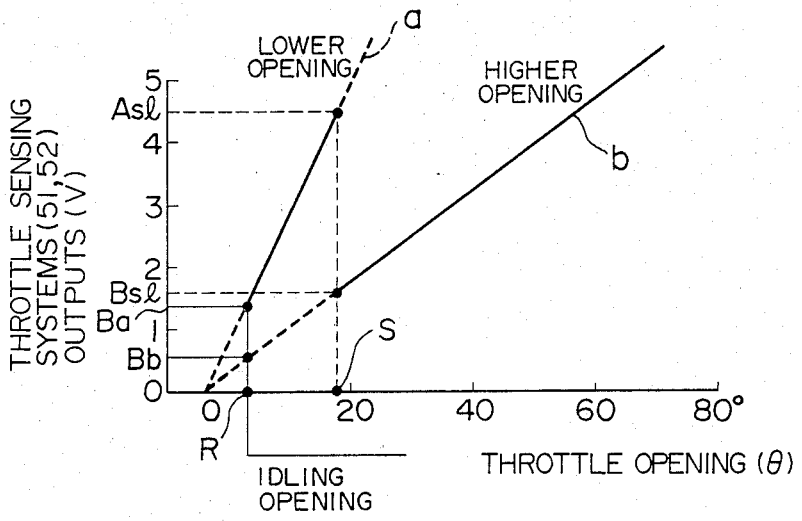
FIG. 4 PRIOR ART
FIG. 4 is a graph showing characteristics of the lower and higher opening region sensing systems.

The throttle opening versus throttle sensor output characteristic diagram shown by way of conventional example of FIG. 4 is utilized to show throttle sensor characteristics for an embodiment of the invention. As shown in FIG. 4, the characteristic of the a track for the lower openings is predetermined in such a manner that the throttle sensor output is between 0.4 and 5.0 V when the throttle opening is between 0° and 20° and the characteristic of the b track for the higher openings is predetermined such that the throttle sensor output is between 0.2 and 5.0 V when the throttle opening is between 0° and 80°. In other words, each of the a and b tracks is predetermined to generate a throttle sensor output when the throttle opening is in the range between 0° and 20°.

Figure 5:
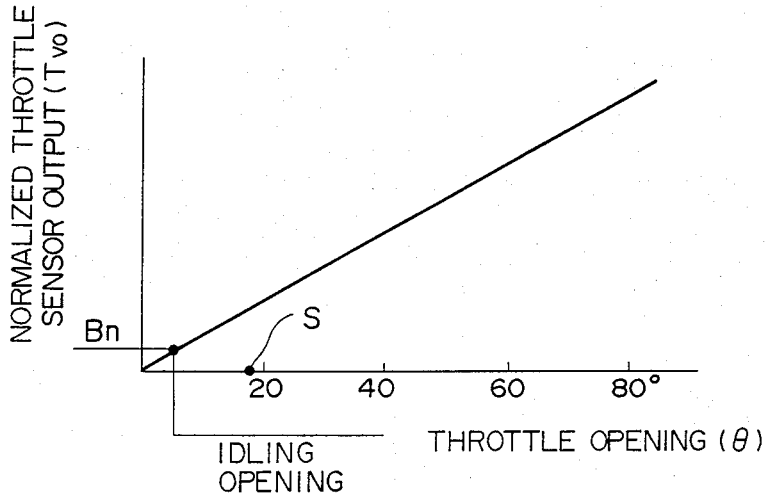
FIG. 5 is a graph showing a throttle sensor output characteristic according to the invention.
Figure 8:
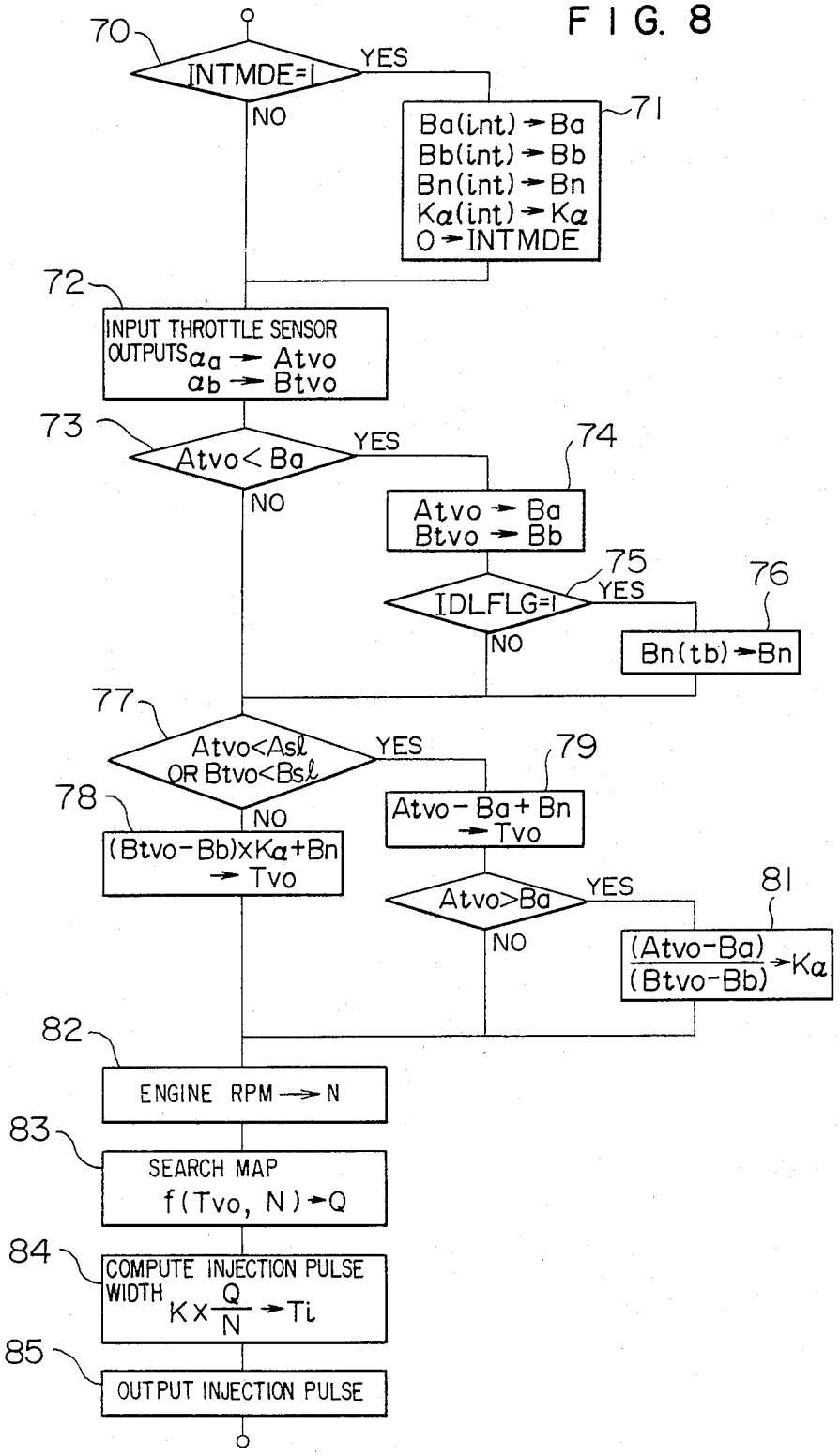
FIG. 8 is a flow chart showing a fuel injection quantity control method according to the invention.

When the outputs of the two throttle sensing systems are applied to the electronically-controlled fuel injection system, computational operations such as shown in FIG. 8 are performed to normalize the sensor outputs as a smooth throttle sensor output Tvo corresponding to the throttle opening as shown in FIG. 5. In accordance with the invention, the normalization is effected so that when the throttle opening is such that the two throttle sensing systems generate outputs simultaneously, the matching between the two is discriminated thereby the control suitably.

Figure 1:
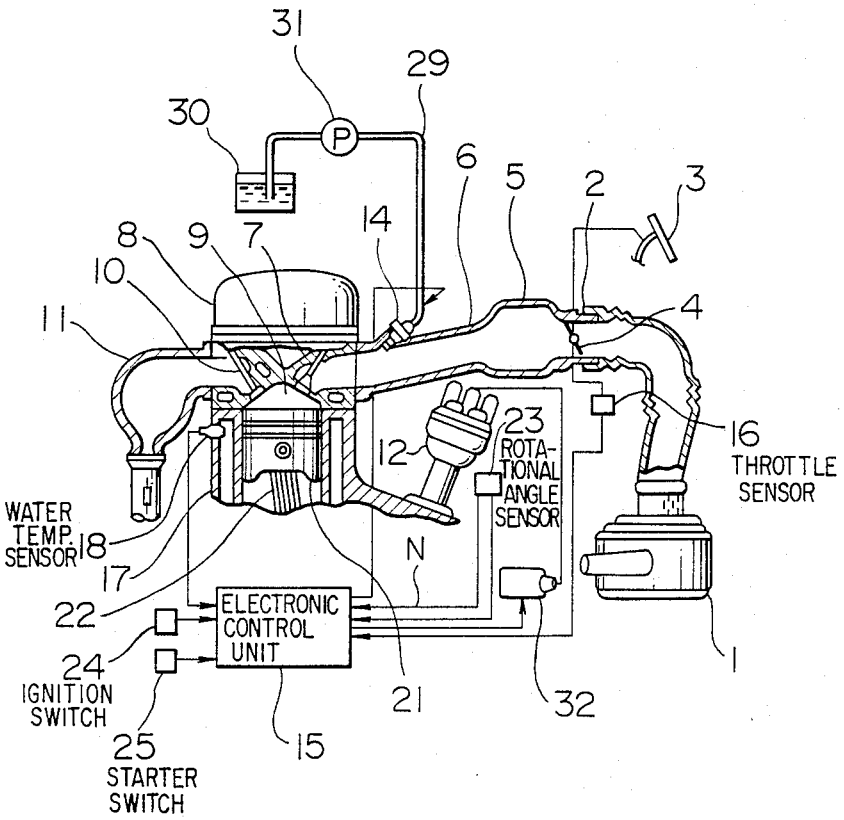
FIG. 1 is a schematic diagram showing the construction of an electronically-controlled fuel injection system well suited for the application of the invention thereto.
Figure 2:
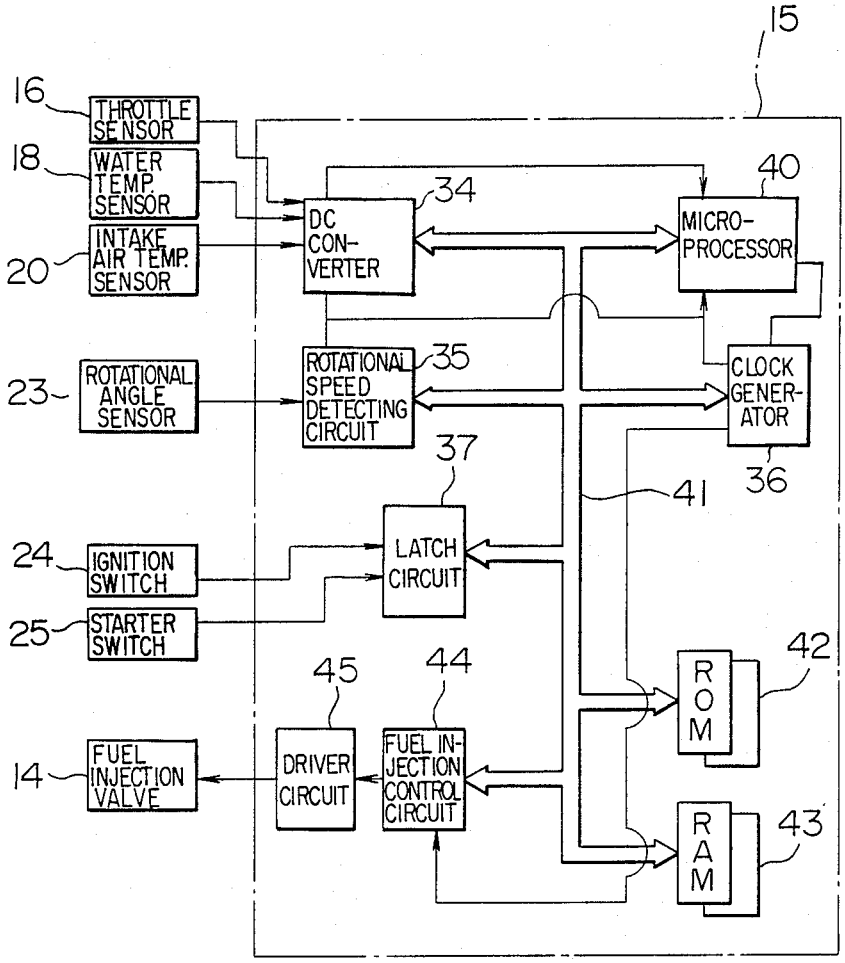
FIG. 2 is a block diagram showing the details of the electronic control unit shown in FIG. 1.
Figure 3:
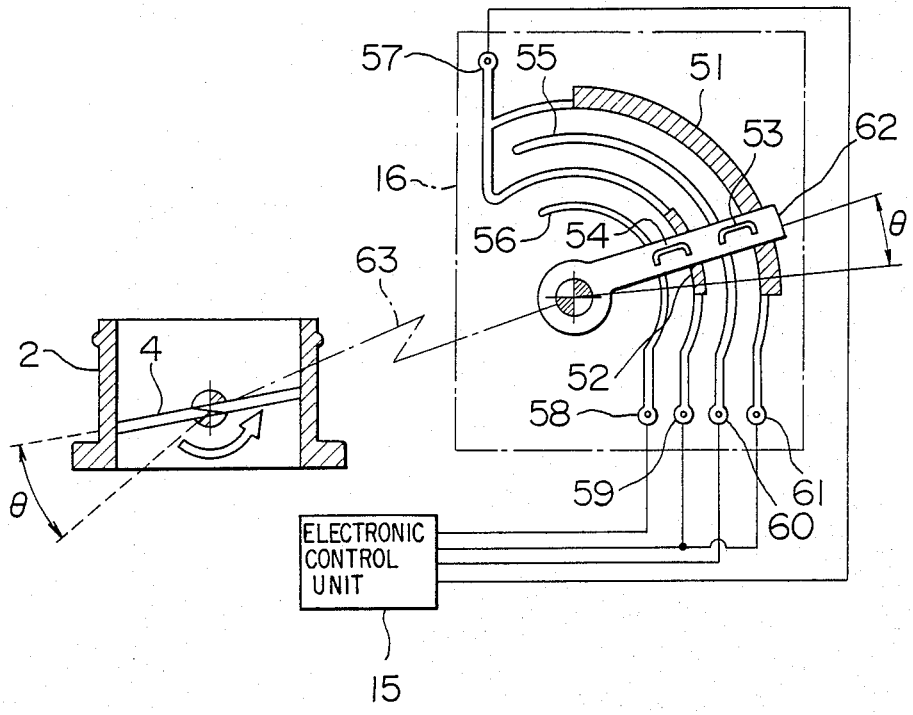
FIG. 3 is a schematic plan view showing the construction of the throttle sensor.

While FIGS. 1 to 4 are employed for explaining the conventional system, the present invention features that the electronic control unit 15 shown in FIGS. 1 and 2 performs operations such as shown in FIG. 8 and therefore FIGS. 1 to 4 can also be used for the purpose of explaining the invention. The control program shown in FIG. 8 is started by another operating program at a given period, e.g., in synchronism with the rotation of the engine.

Referring to FIG. 8, the data stored in an area designated as INTMDE in the RAM 43 is determined at a step 70. When the engine is started, a 1 is set in the area INTMDE by a reset routine whose program is execut3d in response to the connection of the electronic control unit to a power source. In other words, the step 70 determines whether the control program of FIG. 8 is to be executed for the first time. When the step 70 determines that a 1 is set in the area INTMDE, that is, when the program is executed for the first time, the control is transferred to a step 71 where the initial value stored in an area designated as Ba (int) in the ROM 42 is moved to an area designated as Ba in the RAM 43. Similarly, data Bb (int) is substituted for data Bb, data Bn (int) for data Bn and data Kα (int) for data Kα. The data Ba and Bb designate respectively the initial values of the lower and higher opening sensing systems during the initial condition of the engine operation. Also, the data Bn and Kα designate respectively the initial values of the throttle sensor output and the correction factor. After these initial values have been set, the area INTMDE is set to a 0 and the step 71 is thereafter not performed.

Then, the control is transferred to a step 72 where the outputs from the a and b tracks of the throttle sensor 16 are inputted to the computer through the A/D converter 34 and are respectively stored in areas respectively designated as Atvo and Btvo in the RAM 43. Then, at a step 73, data stored in the area Atvo of the RAM 43 is compared with the initial valve Ba so that if the inputted value Atvo is smaller than the initial value Ba, the control is transferred to a step 74 where the inputted values Atvo and Btvo are respectively stored in the areas Ba and Bb. Here, the areas and the data values stored in these areas have the same designations for purposes of simplication.

Figure 6:
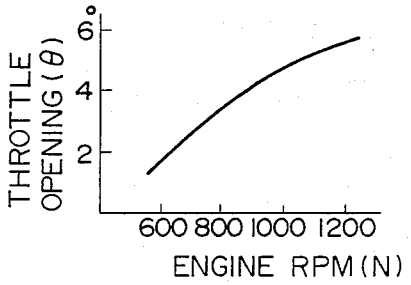
FIGS. 6 and 7 are graphs showing respectively the relation between the engine speed and the table values of the throttle openings and the sensor outputs.
Figure 7:
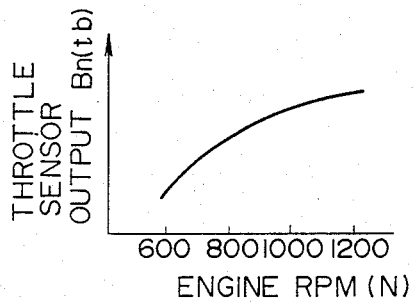

Then, data IDLFLG (abbreviation of an idle flag) discriminated at a step 75 to determine whether the engine is idling is one which has already been set by other program than the one shown in FIG. 8. When the value of IDLFLG is 1, it is an indication that the engine is idling and thus the control is transferred to a step 76 to compute a throttle opening Bn corresponding to the idling opening in the normalized throttle opening characteristic shown in FIG. 5 and store it in an area designated as Bn in the RAM 43. Since there is such correlation between the throttle opening and the engine speed as shown by the characteristic of FIG. 6 during the idle operation, the computation of Bn is effected by interpolation from the Bn (tb) table preliminarily stored in the ROM 42 in relation to the engine speeds as shown in FIG. 7. On the contrary, when it is determined at the step 73 that the value of the Atvo is greater than or equal to the value of Bn, the control is skipped to a step 77 by bypassing the steps 74 to 76. In other words, at the steps 73 to 76, the control operation of detecting the minimum value of the throttle sensor output Atvo, storing the then current Atvo and Btvo in the areas Ba and Bb, respectively, and then computing the value of Bn is performed.

Then, at the step 77, the values of Atvo and Btvo are compared with the values of Asl and Bsl. The Asl and Bsl show slice levels or data preliminarily stored in the ROM for determining which of the lower and higher opening region sensing systems is to be used. When the comparison at the step 77 determined that the a track output value Atvo is smaller than the slice value Asl or the b track output value Btvo is smaller than the slice value Bsl, the lower-opening a track of the higher resolution or greater slope is treated as effective data and the program control is transferred to a step 79. At the step 79, the inputted value of the throttle sensor output is normalized in accordance with the following formula and stored in an area designated as Tvo in the RAM 43.

$$\text{Atvo}-\text{Ba}+\text{Bn}\rightarrow\text{Tvo}$$

When the flow direction of the control is from the step 77 to the step 79, there is a condition where both of the throttle sensor outputs from the a and b tracks are effective for the same throttle opening, the ratio between the slopes of the two outputs can be computed and stored in the RAM 43. In other words, when the value of Atvo inputted at a step 80 is greater than the value of Ba, the control of the program is transferred to a step 81 where the ratio between the slops of the a and b tracks is computed from the following formula and stored in an area designated as Kα in the RAM 43.

$$\frac{(Atvo - Ba)}{(Btvo - Bb)} \rightarrow K\alpha$$

When the comparison at the step 77 determines that the a track inputted value Atvo is greater than the slice level Asl and also the b track inputted value Btvo is greater than the slice level Bsl, the program control is transferred to a step 78 where the throttle sensor inputted value is normalized according to the below-mentioned formula and stored in the area designated as Tvo in the RAM 43.

$$(\text{Btvo}-\text{Bb})\times K\alpha+\text{Bn}\rightarrow\text{Tvo}$$

In other words, the outputs from the two throttle sensing systems can be normalized as shown in FIG. 5 by the control operation of the steps 70 to 81 without causing any deviation or variation of the slops at the switching point (the point S in FIG. 4).

Then, at a step 82, the engine speed is inputted and stored in an area designated as N in the RAM 43. At a step 83, in accordance with the throttle opening Tvo computed at the steps 70 to 81 and the engine speed N inputted at the step 82 the amount of intake air flow is computed (this computation is effected by using a well known computational expression or by reading the corresponding value from a map by a well known method) and the resulting value is stored in an area designated as Q in the RAM 43.

Then, at a step 84, the computation of an injection pulse width is effected in accordance with the following formula and the resulting injection pulse is outputted at a step 85

$$K \times \frac{Q}{N} \rightarrow Ti$$

From the foregoing description it will be seen that the application of the present invention to a fuel injection system of the type including two sensing systems makes it possible to effect the normalization of sensor output values without causing any stepwise variation in the performance curve or any variation in the slope of the performance curve during the changeover between the sensing systesm, thereby preventing any rapid change or time lag of the air-fuel ratio during the changeover. Thus, there is a practical effect that not only the driving performance is prevented from being deteriorated but also the occurrence of any harmful emission is prevented.

We claim:

1. An electronically-controlled fuel injection system for an internal combustion engine comprising:

means including a computer for electronically controlling a fuel injection quantity of an engine;

means for detecting a rotational speed of said engine;

a throttle sensor having lower and higher opening regions for detecting an opening of a throttle valve;

means for storing a ratio between slopes of output voltage characteristic curves respectively derived from said regions with respect to a throttle opening in a range where ranges of throttle openings to be detected in said regions overlap; and means for correctiong an output voltage generated from one of said regions in accordance with said ratio in a throttle opening range exceeding said overlapping range.

2. A system according to claim 1, further comprising means for storing output values generated from said regions when said engine is idling.

3. A system according to claim 2, wherein a value corresponding to a rotational speed of said engine is read as an output value of said throttle sensor from a map stored in memory means.

4. A system according to claim 1, wherein said throttle sensor output is obtained from one of said lower and higher opening regions having a higher throttle opening resolution when said detected opening is within said overlapping range.

5. An electronically-controlled fuel injection system for an internal combustion engine comprising:

means including a computer for electronically controlling a fuel injection quantity of an engine;

means for detecting a rotational speed of said engine;

a throttle sensor having lower and higher opening regions for detecting an opening of a throttle valve;

means whereby a value corresponding to the rotational speed detected by said rotational speed detecting means is read from a map for use as an output value of said throttle sensor when said engine is idling;

means for obtaining an output value of said throttle sensor by utilizing one of said two regions having a higher throttle opening resolution within a range where ranges of throttle openings to be detected in said regions overlap;

means for determining and storing a ratio between slopes a and b of output voltage characteristic curves derived from said regions within said overlapping area; and means for obtaining an output voltage of said throttle sensor by multiplying an output voltage value generated from either one of said regions by said ratio in a throttle opening range exceeding said overlapping range.

* * * * *